US006032950A

United States Patent [19]

Ikeda

[11] Patent Number: 6,032,950

[45] Date of Patent: Mar. 7, 2000

[54] DETECTING DEVICE FOR DETECTING A TRANSFER OBJECT

[75] Inventor: Akihiro Ikeda, Nagoya, Japan

[73] Assignee: Brother Kogyo Kabushiki Kaisha, Nagoya, Japan

[21] Appl. No.: 09/035,067

[22] Filed: Mar. 5, 1998

[30] Foreign Application Priority Data

Mar. 7, 1997 [JP] Japan ..... 9-52725

[51] Int. Cl.[7] ..... B65H 7/02

[52] U.S. Cl. ..... 271/258.01

[58] Field of Search ..... 271/258.01–258.04

[56] References Cited

U.S. PATENT DOCUMENTS 5,615,876 4/1997 Yergenson et al. ..... 271/258.01

FOREIGN PATENT DOCUMENTS 63-300948 12/1988 Japan ..... 271/258.03
2-233434 9/1990 Japan ..... 271/258.01
7-139915 6/1995 Japan .

*Primary Examiner*—Christopher P. Ellis
*Assistant Examiner*—Mark A. Deuble
*Attorney, Agent, or Firm*—Oliff & Berridge, PLC

[57] ABSTRACT

A detecting device is provided for detecting a transfer object. The detecting device includes a reflection type sensor mounted on a support member, an actuator which is pivoted between a first position adjacent to the sensor and a second position away from the sensor, a reflector provided at the free end of the pivotal portion of the actuator for detection by the sensor, and a stopper projection provided on the reflector for contact with the support member when the actuator is pivoted to the first position. The reflector includes a first surface and a second surface inclined relative to the first surface.

21 Claims, 6 Drawing Sheets

DETECTING DEVICE FOR DETECTING A TRANSFER OBJECT

BACKGROUND OF THE INVENTION

1. Field of the Invention

The present invention relates to a detecting device for detecting a transfer object, such as a document sheet or recording paper, in a facsimile machine, a printer, a copying machine or an image scanner for example.

2. Description of the Related Art

In a facsimile machine for example, it is necessary to detect the movement or presence of a transfer object, such as a document sheet or a recording paper sheet, in a transfer path for controlling the operation of the facsimile machine. For this purpose, a detecting device is provided which comprises an actuator and a sensor.

More specifically, as shown in FIG. 8, a prior detecting device comprises an actuator 100 and a sensor 101. The actuator 100 includes a horizontal shaft 100*a*, a first arm 100*b* extending upwardly from the shaft 100*a*, and a second arm 100*c* extending downwardly from one end of the shaft 100*a*. The sensor 101 is mounted on a circuit board 102.

In the absence of a transfer object (not shown) in the transfer path, the first arm 100*b* of the actuator 100 projects into the transfer path. On the other hand, when a transfer object is present in the transfer path, the first arm 100*b* comes into engagement with the transfer object and is thereby pressed downwardly. In this way, the actuator 100 pivots up and down about the horizontal shaft 100*a* in response to the presence and absence of a transfer object.

The second arm 100*c* of the actuator 100 is bent to extend first obliquely and then substantially vertically. Since the second arm 100*c* is thus bent, the actual orientation of the second arm may be represented by an effective length line EL which passes through the center of the actuator shaft 100*a* and the lower end of the second arm 100*c*. In the absence of a transfer object in the transfer path, the angle θ between the effective length line EL of the second arm 100*c* and a vertical line VL passing through the center of the shaft 100*a* is less than 45°.

The lower end of the second arm 100*c* is provided with a reflector 103 which faces the sensor 101 when the second arm 100*c* is pivoted down due to the absence of a transfer object. Further, the reflector 103 has a rounded stopper projection 104 which comes into resting contact with the circuit board 102, thereby maintaining a predetermined clearance $H_1$ between the reflector 103 and the circuit board 102.

The sensor 101 is a reflection type sensor which has a light emitting portion and a light receiving portion. When the actuator 100 is pivoted to bring the stopper projection 104 into contact with the circuit board 102, the light emitted from the light emitting portion of the sensor 101 is reflected on the reflector 103 for incidence into the light receiving portion of the sensor 101, so that the sensor 101 notifies the absence of a transfer object. On the other hand, when the second arm 100*c* of the actuator 100 is pivoted up due to the presence of a transfer object, the reflector 103 becomes far from the sensor 101 to come completely out of the light reflecting position (see the phantom line in the center of FIG. 8), so that the sensor 101 notifies the presence of a transfer object.

Normally, the circuit board 102 is mounted at a standard distance $H_0$ from the actuator shaft 100*a* to make the reflector 103 substantially parallel to the upper surface of the sensor 101 in facing relation thereto (see the center representation in FIG. 8) when the stopper projection 104 of the reflector 104 comes into contact with the circuit board 102. However, it is possible, due to some production or assembly error, that the circuit board 102 may positionally deviate from the standard distance position $H_0$ relative to the actuator shaft 100*a*. If the circuit board 102 is erroneously positioned at a distance ($H_0-\Delta H$) or ($H_0\Delta H$) from the actuator shaft 100*a* (see the left and right representations in FIG. 8), the orientation of the reflector 103 becomes improper relative to the upper surface of the sensor 101. As a result, the sensor 101 may fail to provide a reliable detection of a transfer object. Such a disadvantage will become particularly remarkable as the angle θ between the effective length line EL of the actuator second arm 100*c* and the vertical line VL is small.

SUMMARY OF THE INVENTION

It is, therefore, an object of the present invention is to provide a detecting device which is capable of reliably detecting a transfer object, particularly a paper sheet for use in e.g. a facsimile machine, even if a circuit board or support member for a sensor positionally deviates from a standard mounting position According to one aspect of the present invention, there is provided a detecting device for detecting a transfer object which is transferred along a predetermined transfer path, the detecting device comprising: a non-contact sensor mounted on a support member; an actuator including a contact portion for contact with the transfer object in the transfer path, and a pivotal portion which is pivotable about a pivotal axis between a first position adjacent to the sensor and a second position away from the sensor, the pivotal portion having a free end; a cooperative element provided at the free end of the pivotal portion of the actuator for detection by the sensor; and a stopper projection provided on the cooperative element for contact with the support member when the pivotal portion of the actuator is pivoted to the first position; wherein the cooperative element includes a first surface and a second surface inclined relative to the first surface.

The technical advantages obtainable with the above-described detecting device will be specifically described hereinafter on the basis of the preferred embodiments of the present invention.

The cooperative element may further include a third surface inclined relative to the first surface and the second surface. In this case, the first surface may be provided at a central portion of the cooperative element, whereas the second and third surfaces may be located at a respective side portion of the cooperative element and inclined in mutually opposite directions Typically, the sensor may be a reflection type sensor for optical detection, whereas the cooperative element may be a reflector with each of the first and second surfaces (or the first to third surfaces) acting as a reflecting surface.

According to a preferred embodiment, the actuator comprises a first arm as the contact portion and a second arm as the pivotal portion, and the first arm projects into the transfer path when the second arm is in the first position. Further, the second arm of the actuator extends downwardly from the pivotal axis in a bent manner. Preferably in this case, an angle formed between a vertical line passing through the pivotal axis and an effective length line of the second arm passing through the pivotal axis and the free end of the second arm should be less than 45°.

According to another aspect of the present invention, there is provided a detecting device for detecting a transfer object which is transferred along a predetermined transfer path, the detecting device comprising: a non-contact sensor mounted on a support member; an actuator including a contact portion for contact with the transfer object in the transfer path, and a pivotal portion which is pivotable about a pivotal axis between a first position adjacent to the sensor and a second position away from the sensor, the pivotal portion having a free end; a cooperative element provided at the free end of the pivotal portion of the actuator for detection by the sensor; and a stopper projection provided on the cooperative element for contact with the support member when the pivotal portion of the actuator is pivoted to the first position; wherein the cooperative element includes a round surface which is convex toward the sensor in facing relation thereto when the pivotal portion is pivoted to the first position.

Preferably, the round surface of the cooperative element may be arcuately curved. In this case, it is advantageous if the arcuately curved round surface of the cooperative element is generally centered about the pivotal axis.

Again, in the second aspect of the present invention, the sensor may typically be a reflection type sensor for optical detection, whereas the cooperative element may be a reflector with the round surface acting as a reflecting surface.

According to a further aspect of the present invention, there is provided a detecting device for detecting a transfer object which is transferred along a predetermined transfer path, the detecting device comprising: a reflection type sensor mounted on a support member; an actuator including a contact portion for contact with the transfer object in the transfer path, and a pivotal portion which is pivotable about a pivotal axis between a first position adjacent to the sensor and a second position away from the sensor, the pivotal portion having a free end; a reflector provided at the free end of the pivotal portion of the actuator for detection by the sensor; and a stopper projection provided on the reflector for contact with the support member when the pivotal portion of the actuator is pivoted to the first position; wherein wall thickness of the reflector is maximum at a central portion of the reflector but progressively reduces toward at least one side of the reflector.

Preferably, the wall thickness of the reflector progressively reduces toward both sides of the reflector.

Other objects, features and advantages of the present invention will be apparent from the detailed description of a preferred embodiment given below with reference to the accompanying drawings.

DETAILED DESCRIPTION OF THE PREFERRED EMBODIMENTS

The preferred embodiments of the present invention will be described below with reference to the accompanying drawings.

Figure 1:
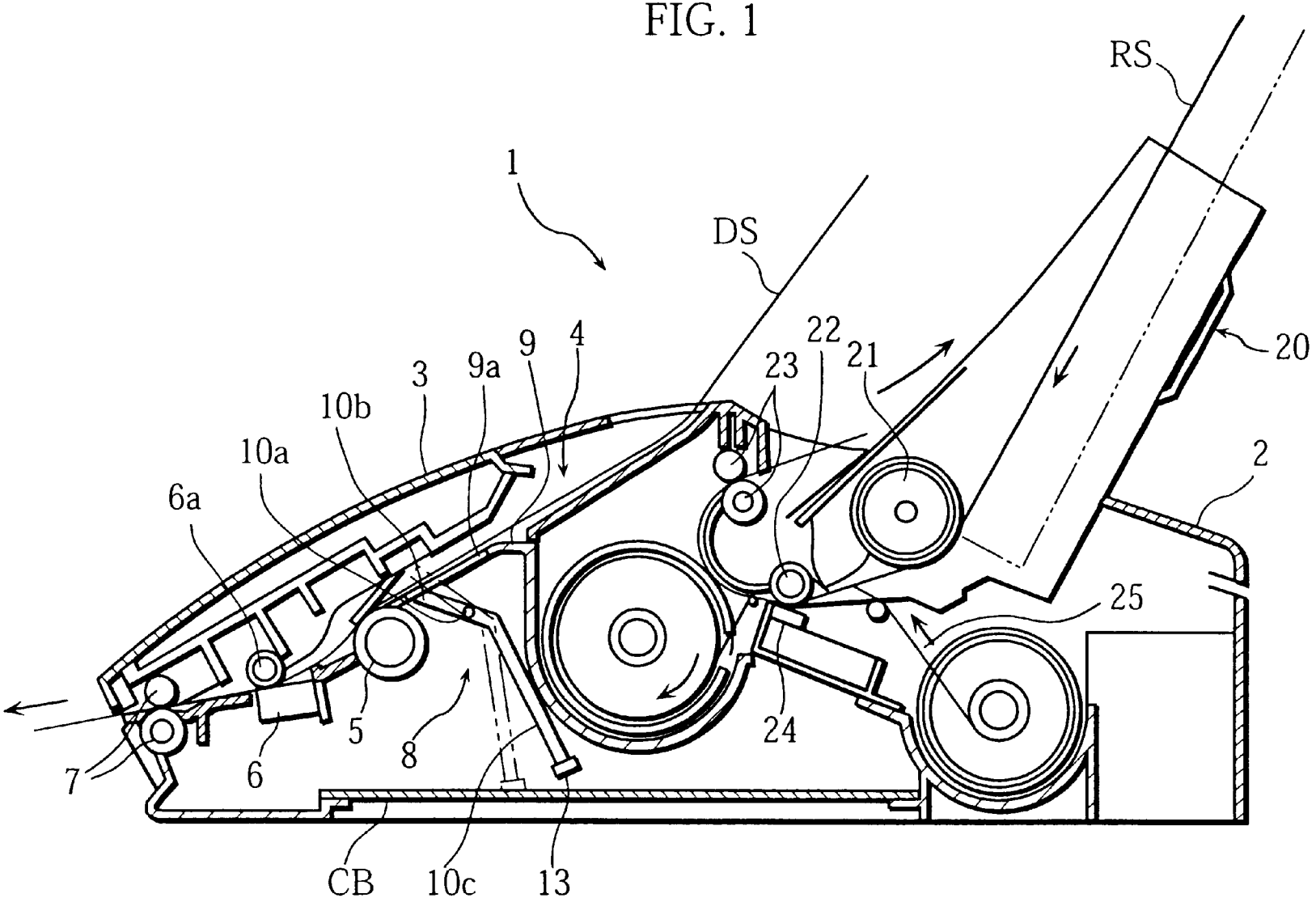
FIG. 1 is a sectional view showing a facsimile machine which incorporates a detecting device embodying the present invention.

FIG. 1 of the accompanying drawings represents an overall view of a facsimile machine which incorporates a detecting device embodying the present invention. The facsimile machine generally represented by reference numeral 1 comprises a housing 2 which includes a front operation/display panel 3 provided with key switches (not shown) and liquid crystal display devices (not shown). Immediately under the front panel 3 is formed a document transfer path 4.

A document sheet DS is transferred along the document transfer path 4 by a feed roller 5, a platen roller 6*a* and a pair of discharge rollers 7. These rollers are driven by a drive motor (not shown) through a transmission gear mechanism (not shown). In the course of such transfer, the images (including characters, letters, numerals and etc.) carried on the document sheet DS is optically read by an image reader (e.g. CCD image scanner) 6 arranged in facing relation to the platen roller 6*a*.

The housing 2 supports a recording paper receiver 20 for receiving a stack of recording paper sheets RS. Each of the recording paper sheets RS is transferred by a feed roller 21, a platen roller 22 and a pair of discharge rollers 23. These rollers are driven by a drive motor (not shown) through a transmission gear mechanism (not shown). In the course of such transfer, the recording paper sheet RS is subjected to printing by means of a printhead 24 held in facing relation to the platen roller 22 with an ink ribbon held therebetween.

The present invention may be applied for detecting either one or both of the document sheet DS and the recording paper sheet RS. For the convenience of illustration and description, however, the present invention is applied only for detecting the document sheet DS alone in the illustrated embodiment.

More specifically, for detecting the presence of the document sheet DS in the document transfer path 4, a detecting device 8 is provided under a guide wall 9 which defines a part of the document transfer path 4. The detecting device 8 is arranged behind the feed roller 5. The guide wall 9 is provided with a slit 9*a*.

Figure 2:
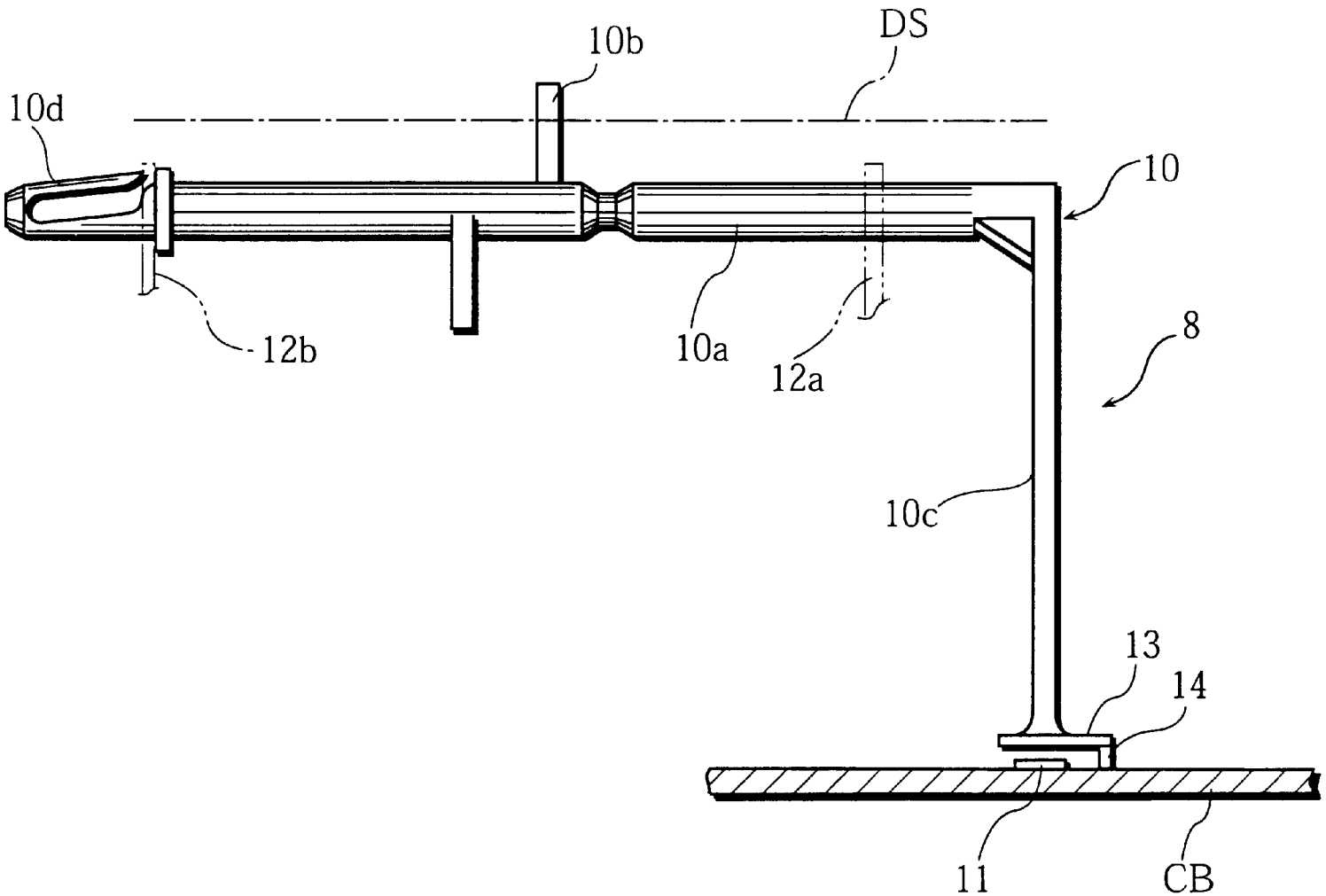
FIG. 2 is a front view showing the same detecting device.

As shown in FIG. 2, the detecting device 8 comprises an actuator 10 and a sensor 11. The actuator 10 includes a horizontal shaft 10*a*, a first or upper arm 10*b* extending upwardly from an intermediate portion of the shaft 10*a*, and a second or lower arm 10*c* extending downwardly from one end of the shaft 10*a*. The shaft 10*a* is rotatably supported by a first support bracket 12*a* adjacent to the second arm 10*c*, and by a second support bracket 12*b* at the remote end of the shaft 10*d*.

The first support bracket 12*a* has a U-shaped groove (see FIG. 3) for rotatably fitting the shaft 10*a* from above, whereas the second support bracket 12*b* has a circular hole (not shown) for rotatably receiving the remote end of the shaft 10*a*. Further, the remote end of the shaft 10*a* is formed with an elastically expandable flange 10*d* for preventing unexpected removal of the shaft 10*a* from the second support bracket 12*b*.

If no document sheet is present at the inlet of the document transfer path 4 the first arm 10*b* of the actuator 10 projects into the document transfer path 4 through the slit 9*a* of the guide wall 9, as indicated by phantom lines in FIG. 1. On the other hand, when a document sheet DS is present at the inlet of the document transfer path 4, the first arm 10*b* comes into engagement with the document sheet DS and is thereby depressed into the slit 9*a*, as indicated by solid lines in FIG. 1. In this way, the actuator 10 pivots up and down about the horizontal shaft 10*a* in response to the presence and absence of a document sheet DS.

Figure 3:
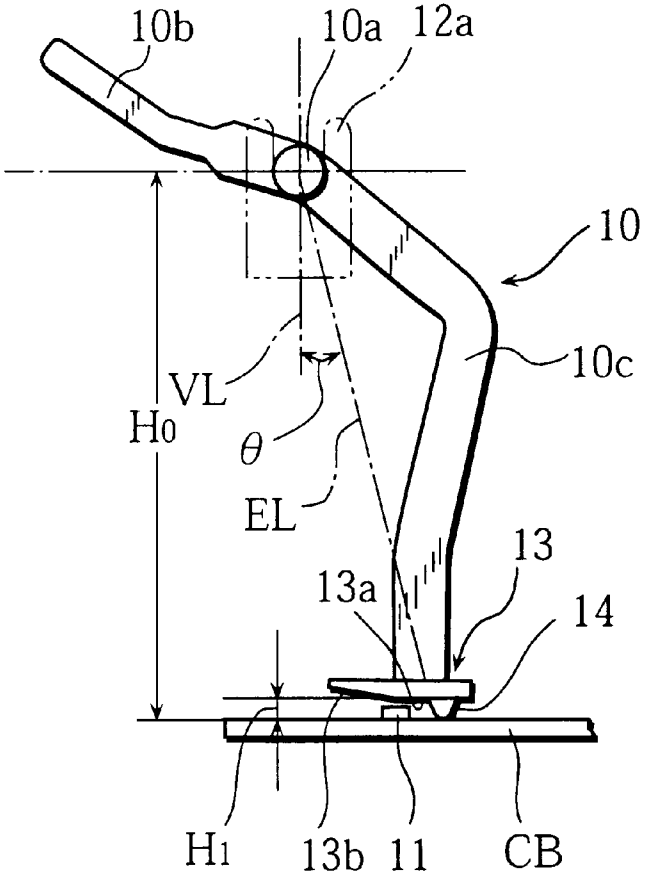
FIG. 3 is a side view showing the same detecting device with a circuit board mounted at a standard position.

As shown in FIGS. 2 and 3, the second arm 10*c* of the actuator 10 is bent to extend first obliquely and then substantially vertically. Since the second arm 10*c* is thus bent, the actual orientation of the second arm may be represented by an effective length line EL (FIG. 3) which passes through the center of the actuator shaft 10*a* and the lower end of the second arm 10*c*. When the actuator 10 assumes the paper-out position (the phantom line position in FIG. 1), the angle θ between the effective length line EL of the second arm 10*c* and a vertical line VL passing through the center of the shaft 10*a* is less than 45° according to the illustrated embodiment.

The lower end of the second arm 10*c* is provided with a reflector 13 which faces the sensor 11 when the second arm 10*c* is pivoted down due to the absence of a document sheet DS (see the phantom line position in FIG. 1). The sensor 11 is mounted on a circuit board CB which is, in turn, supported substantially horizontally at the bottom of the housing 2 (FIG. 1). Further, the reflector 13 has a rounded stopper projection 14 which comes into resting contact with the circuit board CB, thereby maintaining a predetermined clearance $H_1$ between the reflector 13 and the circuit board CB.

The sensor 11 is a reflection type sensor which has a light emitting portion and a light receiving portion. When the actuator 10 assumes the paper-out position (the phantom line position in FIG. 1), the light emitted from the light emitting portion of the sensor 11 is reflected on the reflector 13 for incidence into the light receiving portion of the sensor 11, so that the sensor 11 generates a paper-out signal. On the other hand, when the actuator 10 assumes the paper-in position (the solid line position in FIG. 1), the reflector 13 becomes far from the sensor 11 to come completely out of the light reflecting position, so that the sensor 11 generates a paper-in signal.

As previously described, the angle θ between the effective length line EL of the actuator second arm 10*c* and the vertical line VL is less than 45° when the actuator 10 assumes the paper-out position. Thus, even if the pivotal angle of the actuator 10 caused by the presence of the document sheet DS is relatively small, the reflector 13 at the lower end of the second arm 10*c* may be brought sufficiently far from the sensor 11 for reliable detection of the sheet presence.

As shown in FIG. 3, the reflector 13 according to a first embodiment of the present invention has a first reflecting surface 13*a* and a second reflecting surface 13*b*. The reflector 13 may be entirely formed of a white resin to make the first and second reflecting surfaces 13*a*, 13*b* sufficiently reflective to light. Alternatively, a white coating or film may be applied to the bottom surface of the reflector 13 for making the first and second reflecting surfaces 13*a*, 13*b* sufficiently reflective.

If the circuit board CB is positioned at a standard distance $H_0$ from the actuator shaft 10*a*, the first surface 13*a* of the reflector 13 becomes substantially parallel to the circuit board CB (i.e., the upper surface of the sensor 11) in facing relation to the sensor 11 when the actuator 10 assumes the paper-out position. As a result, the light from the light emitting portion of the sensor 11 is reflected on the first reflecting surface 13*a* of the reflector 13 for reentry into the light receiving portion of the sensor, whereby the sensor 11 generates a paper-out signal. The second reflecting surface 13*b* is inclined relative to the first reflecting surface 13*a* to be progressively farther from the circuit board CB as it extends away from the first reflecting surface 13*a*. If the circuit board CB is positioned at the standard distance $H_0$ from the actuator shaft 10*a*, the second reflecting surface 13*b* is oriented away from the sensor 11 when the actuator 10 assumes the paper-out position.

Figure 4:
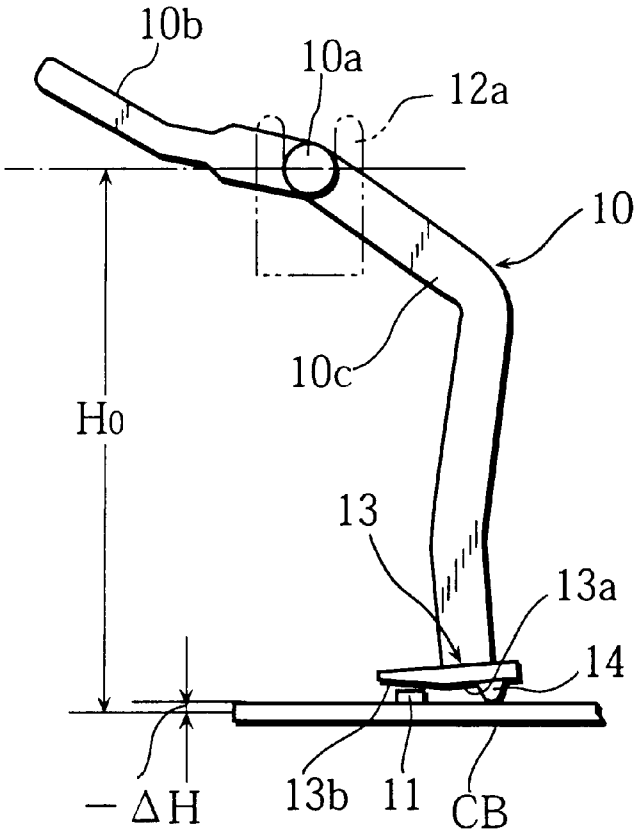
FIG. 4 is a side view similar to FIG. 3 but showing the same detecting device with a circuit board mounted slightly upward from the standard position.

On the other hand, it is possible, due to some production or assembly error, that the circuit board CB may positionally deviate from the standard distance or position $H_0$ relative to the actuator shaft 10*a*. It is now assumed that the circuit board CB is erroneously positioned at a distance ($H_0-\Delta H$) from the actuator shaft 10*a*, as shown in FIG. 4. In this case, when the stopper projection 14 comes into contact with the circuit board CB in the paper-out pivotal position of the actuator 10, the second reflecting surface 13*b* becomes substantially parallel to the circuit board CB (i.e., the upper surface of the sensor 11) in facing relation to the sensor 11. As a result, the light from the light emitting portion of the sensor 11 is reflected on the second reflecting surface 13*b* of the reflector 13 for reentry into the light receiving portion of the sensor, whereby the sensor 11 generates a paper-out signal.

In this way, either one of the first and second reflecting surfaces 13*a*, 13*b* of the reflector 13 may be held substantially parallel to the upper surface of the sensor 11 in facing relation thereto in the paper-out pivotal position of the actuator 10. Thus, even if the circuit board CB positionally deviates from the standard distance position $H_0$ relative to the actuator shaft 10*a*, the sensor 11 can reliably generate a paper-out signal when no document sheet is present at the inlet of the document transfer path 4.

Figure 5:
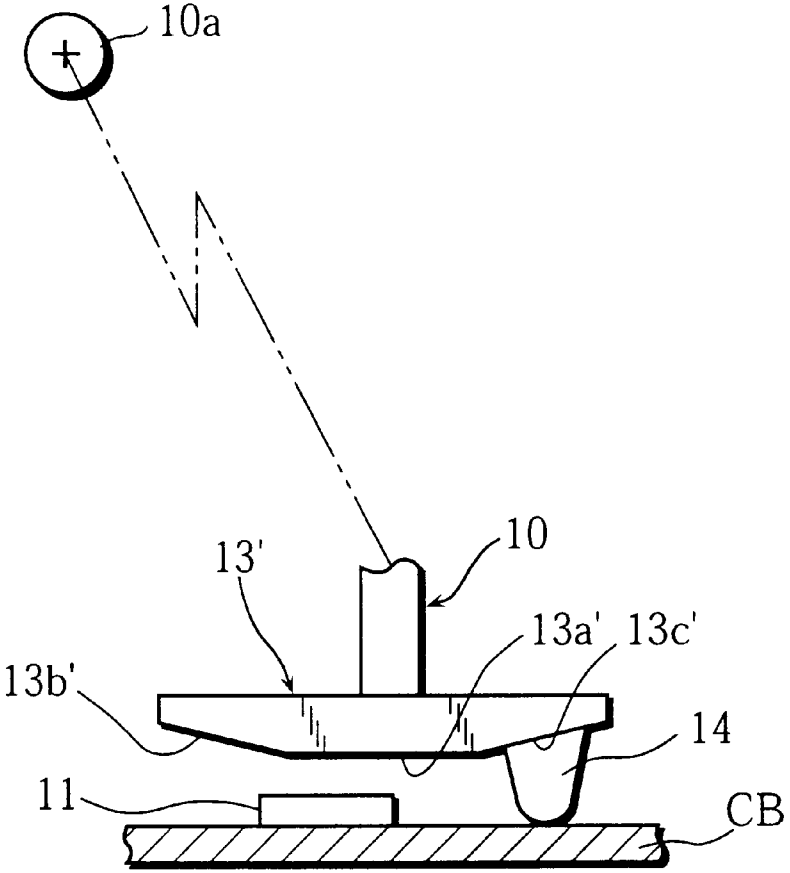
FIG. 5 is a schematic side view showing another detecting device embodying the present invention, with a circuit board mounted at the standard position.

FIG. 5 represents a second embodiment of reflector according to the present invention. Specifically, the reflector in the second embodiment, designated by reference numeral 13', has a first reflecting surface 13*a*' at a central portion of the reflector, a second reflecting surface 13*b*' at one side portion of the reflector, and a third reflecting surface 13*c*' at the opposite side portion of the reflector. The second and third reflecting surfaces 13*b*, 13*c*' are inclined relative to the first reflecting surface 13*a*' to become progressively farther from the circuit board CB as they extend away from the first reflecting surface 13*a*'. Thus, the second and third reflecting surfaces 13*b*', 13*c*' are oppositely inclined.

According to the second embodiment, if the circuit board CB is positioned at the standard distance $H_0$ from the actuator shaft 10*a*, the first surface 13*a*' of the reflector 13' becomes substantially parallel to the upper surface of the sensor 11 in facing relation thereto when the actuator 10 assumes the paperout position (see FIGS. 3 and 5). If the circuit board CB is erroneously positioned at a distance ($H_0-\Delta H$) from the actuator shaft 10*a*, the second reflecting surface 13*b*' becomes substantially parallel to the upper surface of the sensor 11 in facing relation thereto (see FIG. 4).

Figure 6:
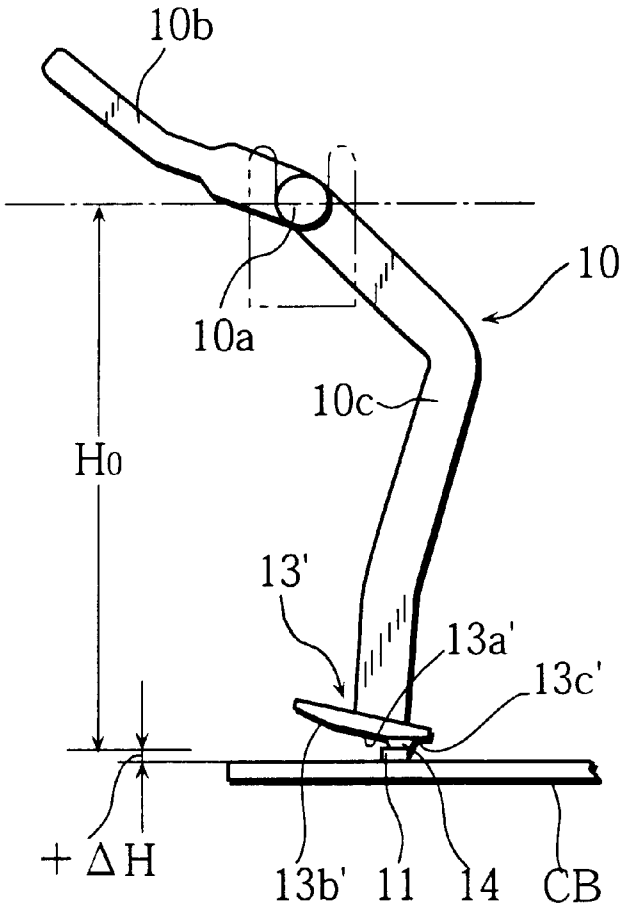
FIG. 6 is a side view showing the detecting device of FIG. 5 with a circuit board mounted slightly downward from the standard position.

Further, if the circuit board CB is erroneously positioned at a distance ($H_0-\Delta H$) from the actuator shaft 10*a*, the third reflecting surface 13*c*' becomes substantially parallel to the upper surface of the sensor 11 in facing relation thereto when the actuator 10 assumes the paper-out position, as shown in FIG. 6 As a result, the light from the light emitting portion of the sensor 11 is reflected on the third reflecting surface 13*c*' of the reflector 13' for reentry into the light receiving portion of the sensor, whereby the sensor 11 generates a paper-out signal. Thus, the second embodiment is advantageous in that the circuit board CB may positionally deviate either upward or downward.

Figure 7:
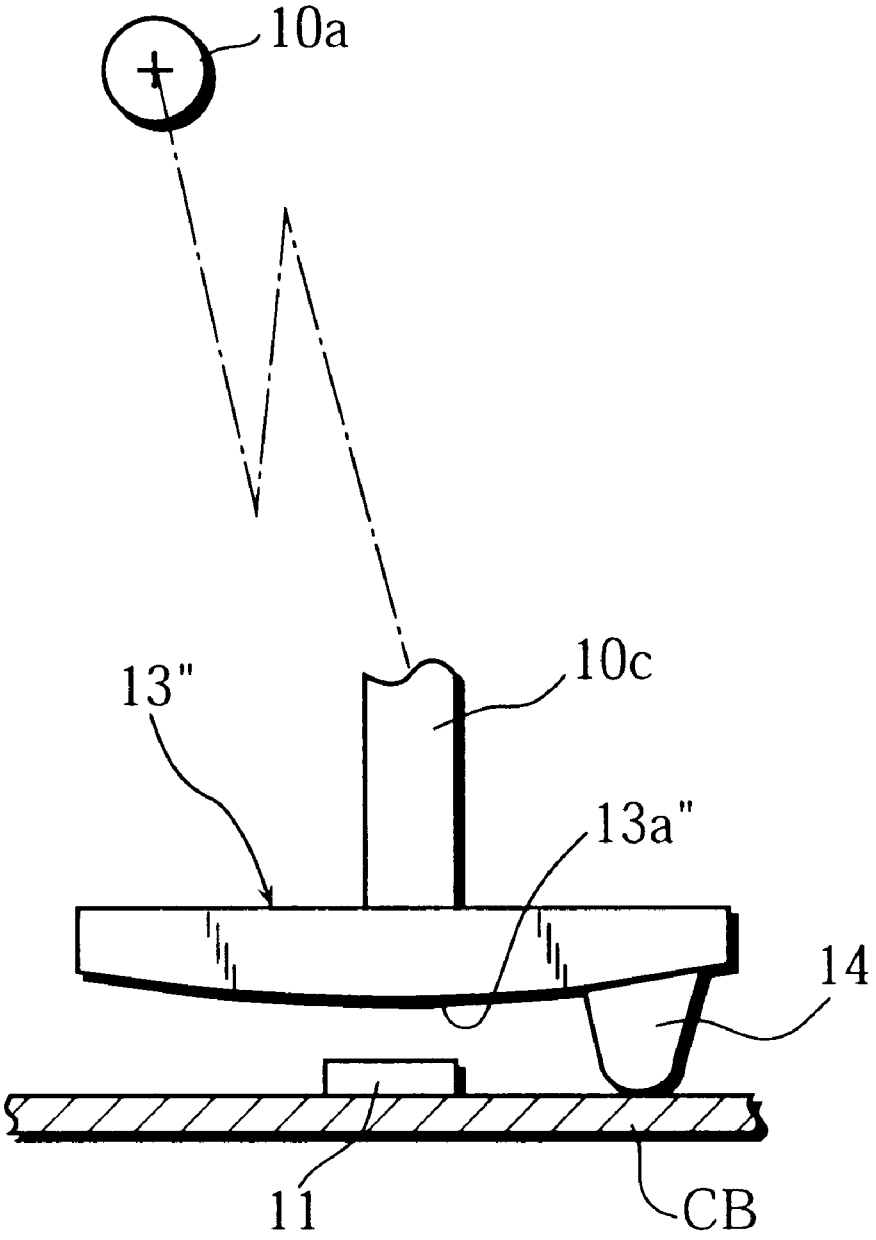
FIG. 7 is a schematic side view showing a further detecting device embodying the present invention, with a circuit board mounted at the standard position.
Figure 8:
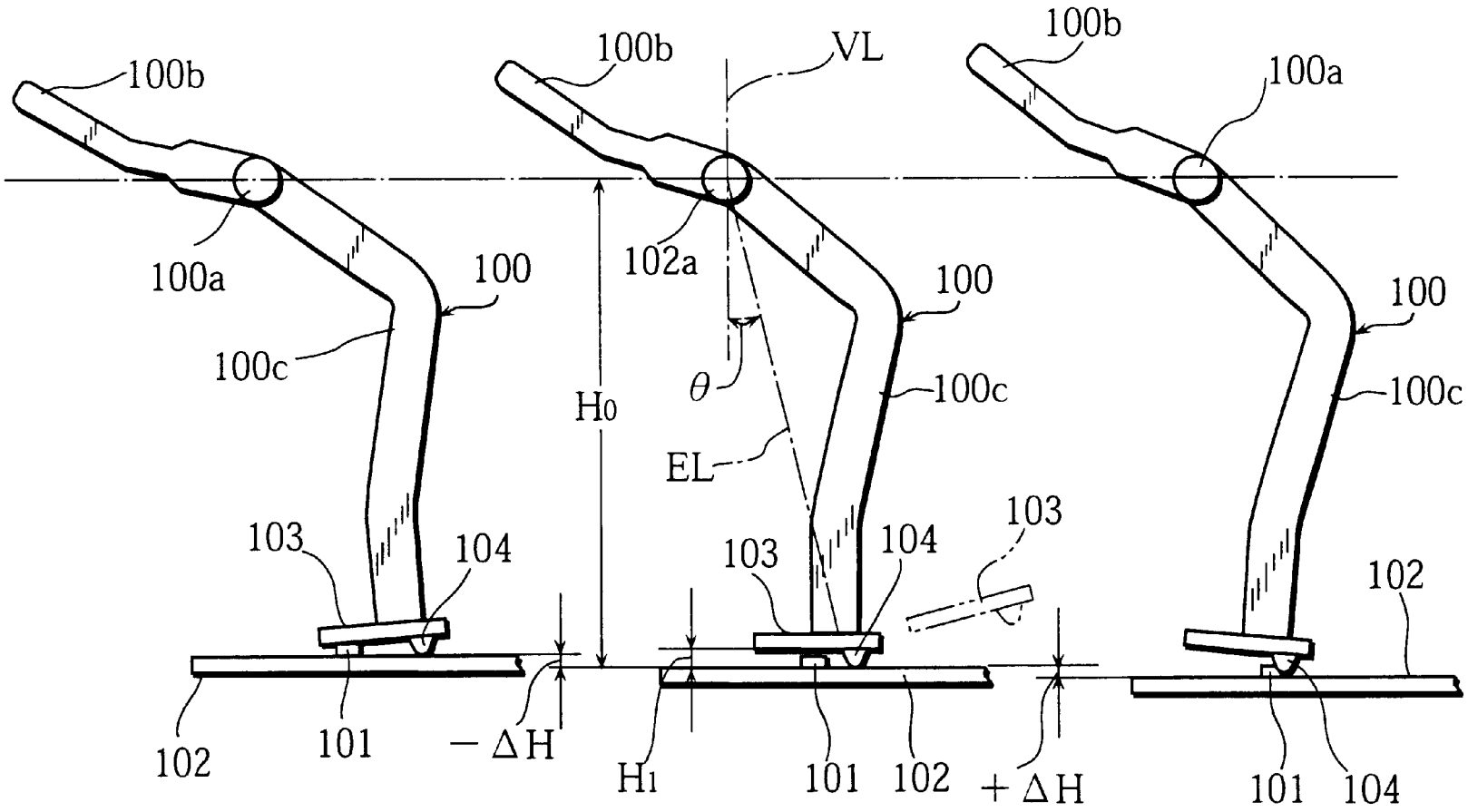
FIG. 8 PRIOR ART
FIG. 8 is a side view showing a prior art detecting device in three different positions.

FIG. 7 represents a third embodiment of reflector according to the present invention. Specifically, the reflector in the third embodiment, designated by reference numeral 13", has a single reflecting surface 13*a*" which is arcuately curved. The arcuate reflecting surfaces 13*a*" may be generally centered about the actuator shaft 10*a*.

According to the third embodiment, even if the circuit board CB positionally deviates upward or downward from the standard distance position Ho from the actuator shaft 10*a*, some portion of the arcuate reflecting surface 13" faces the upper surface of the sensor 11 substantially in parallel thereto when the actuator 10 assumes the paper-out position with the stopper projection 14 resting on the circuit board CB. As a result, the light from the light emitting portion of the sensor 11 is reflected on the facing portion of the arcuate reflecting surface 13*a*" of the reflector 13' for reentry into the light receiving portion of the sensor, whereby the sensor 11 generates a paper-out signal. Thus, the third embodiment is advantageous in that the sensor 11 can always provide a reliable paper-out detection regardless of the degree and direction of positional deviation of the circuit board CB.

The preferred embodiments of the present invention being thus described, it is obvious that the same may be varied in many other ways. For instance, the reflector 13' shown in FIG. 5 may include four or more reflecting surfaces which inclined relative to each other. Further, the configuration of the first and second arms 10*a*, 10*b* of the actuator 10 may be modified, provided that the actuator can perform the intended detecting function. Such variations should not be regarded as a departure from the spirit and scope of the present invention, and all such modifications as would be obvious to those skilled in the art are intended to be included within the scope of the following claims

I claim:

1. A detecting device for detecting a transfer object which is transferred along a predetermined transfer path, the detecting device comprising:

a non-contact sensor mounted on a support member;

an actuator including a contact portion for contact with the transfer object in the transfer path, and a pivotal portion which is pivotable about a pivotal axis between a first position adjacent to the sensor and a second position away from the sensor, the pivotal portion having a free end;

a cooperative element provided at the free end of the pivotal portion of the actuator for detection by the sensor; and a stopper projection provided on the cooperative element for contact with the support member when the pivotal portion of the actuator is pivoted to the first position;

wherein the cooperative element includes a first surface and a second surface inclined relative to the first surface, the first surface and the second surface being selectively brought into facing relation to the sensor.

2. The detecting device according to claim 1, wherein the cooperative element further includes a third surface inclined relative to the first surface and the second surface.

3. The detecting device according to claim 2, wherein the first surface is provided at a central portion of the cooperative element, the second surface being located on one side portion of the cooperative element and inclined in one direction relative to the first surface, the third surfaces being located on an opposite side portion of the cooperative element and inclined in an opposite direction relative to the first surface.

4. The detecting device according to claim 2, wherein the sensor is a reflection type sensor for optical detection, the cooperative element being a reflector with each of the first to third surfaces acting as a reflecting surface.

5. The detecting device according to claim 1, wherein the sensor is a reflection type sensor for optical detection, the cooperative element being a reflector with each of the first and second surfaces acting as a reflecting surface.

6. The detecting device according to claim 1, wherein the actuator comprises a f irst arm as the contact portion and a second arm as the pivotal portion, the first arm projecting into the transfer path when the second arm pivots to the first position.

7. The detecting device according to claim 6, wherein the second arm of the actuator extends downwardly from the pivotal axis in a bent manner, an angle formed between a vertical line passing through the pivotal axis and an effective length line of the second arm passing through the pivotal axis and the free end of the second arm being less than 45°.

8. A detecting device for detecting a transfer object which is transferred along a predetermined transfer path, the detecting device comprising:

a non-contact sensor mounted on a support member;

an actuator including a contact portion for contact with the transfer object in the transfer path, and a pivotal portion which is pivotable about a pivotal axis between a first position adjacent to the sensor and a second position away from the sensor, the pivotal portion having a free end;

a cooperative element provided at the free end of the pivotal portion of the actuator for detection by the sensor; and a stopper projection provided on the cooperative element for contact with the support member when the pivotal portion of the actuator is pivoted to the first position;

wherein the cooperative element includes a round surface which is convex toward the sensor in facing relation thereto when the pivotal portion is pivoted to the first position.

9. The detecting device according to claim 8, wherein the round surface of the cooperative element is arcuately curved.

10. The detecting device according to claim 9, wherein the arcuately curved round surface of the cooperative element is generally centered about the pivotal axis.

11. The detecting device according to claim 8, wherein the sensor is a reflection type sensor for optical detection, the cooperative element being a reflector with the round surface acting as a reflecting surface.

12. The detecting device according to claim 8, wherein the actuator comprises a first arm as the contact portion and a second arm as the pivotal portion, the first arm projecting into the transfer path when the second arm pivots to the first position.

13. The detecting device according to claim 12, wherein the second arm of the actuator extends downwardly from the pivotal axis in a bent manner, an angle formed between a vertical line passing through the pivotal axis and an effective length line of the second arm passing through the pivotal axis and the free end of the second arm being less than 45°.

14. A detecting device for detecting a transfer object which is transferred along a predetermined transfer path, the detecting device comprising:

a reflection type sensor mounted on a support member;

an actuator including a contact portion for contact with the transfer object in the transfer path, and a pivotal portion which is pivotable about a pivotal axis between a first position adjacent to the sensor and a second position away from the sensor, the pivotal portion having a free end; and a reflector provided at the free end of the pivotal portion of the actuator for detection by the sensor, the reflector being provided with a reflective body and a stopper projection for contact with the support member when the pivotal portion of the actuator is pivoted to the first position;

wherein wall thickness of the reflective body is maximum at the central portion of the reflective body but progressively reduces toward at least one side of the reflective body.

15. The detecting device according to claim 14, wherein the wall thickness of the reflective body progressively reduces toward both sides of the reflective body.

16. The detecting device according to claim 15, wherein the reflective body includes a first reflecting surface at the central portion of the reflective body, a second reflecting surface at one side portion of the reflective body, and a third reflecting surface at an opposite side portion of the reflective body.

17. The detecting device according to claim 15, wherein the reflector has a round reflecting surface which is convex toward the sensor in facing relation thereto when the pivotal portion of the actuator is in the first position.

18. The detecting device according to claim 17, wherein the round reflecting surface of the reflector is arcuately curved.

19. The detecting device according to claim 18, wherein the arcuately curved round surface of the cooperative element is generally centered about the pivotal axis.

20. The detecting device according to claim 14, wherein the reflective body includes a first reflecting surface at the central portion of the reflective body, and a second reflecting surface at one side portion of the reflective body.

21. A detecting device for detecting a transfer object which is transferred along a predetermined transfer path, the detecting device comprising:

a non-contact sensor mounted on a support member;

an actuator including a contact portion for contact with the transfer object in the transfer path, and a pivotal portion which is pivotable about a pivotal axis between a first position adjacent to the sensor and a second position away from the sensor, the pivotal portion having a free end;

a cooperative element provided at the free end of the pivotal portion of the actuator for detection by the sensor; and a stopper for stopping the pivotal portion in the first position;

wherein the cooperative element includes a first surface and a second surface inclined relative to the first surface, the first surface and the second surface being selectively brought into facing relation to the sensor.

* * * * *